United States Patent [19]

Padovani

[11] Patent Number: 4,553,692

[45] Date of Patent: Nov. 19, 1985

[54] CONTAINER HAVING CLOSURE GUIDE MEMBERS

[75] Inventor: Pietro Padovani, Verona, Italy

[73] Assignee: Industrie Specializzate Articoli Plastici SpA, Parona, Italy

[21] Appl. No.: 619,350

[22] Filed: Jun. 11, 1984

[51] Int. Cl.[4] ..... B65D 1/26

[52] U.S. Cl. ..... 229/2.5 EC; 220/339

[58] Field of Search ..... 229/2.5 EC; 220/339

[56] References Cited

U.S. PATENT DOCUMENTS

| | | | |
|---|---|---|---|
| 2,515,113 | 7/1950 | Chaplin | 229/2.5 EC |
| 3,351,270 | 11/1967 | Hohnjec | 229/2.5 EC |
| 3,655,110 | 4/1972 | Eisenbach | 229/2.5 EC |
| 4,059,219 | 11/1977 | Reifers et al. | 229/2.5 EC |

FOREIGN PATENT DOCUMENTS

| | | | |
|---|---|---|---|
| 258192 | 2/1967 | Austria | 229/2.5 EC |
| 1418897 | 12/1975 | United Kingdom | 229/2.5 EC |

*Primary Examiner*—Joseph Man-Fu Moy

[57] ABSTRACT

A container having closure guide members for eggs, fruit or like products, which container is constructed from a sheet of synthetic thermoplastics material and is formed of two parts or portions (9, 10) held together by a flat spine and by two grooves (15) bounding the spine, and having recesses (12) to house the products in at least one of the parts (9, 10) which have mating ledges (22, 22', 22'', 22''') and cylindrical spacers (38), the said parts (9,10) being capable of being closed together by means of pressure closure members (16, 17) in such a way that the said mating surfaces are in contact with each other, in which the closure guide members consist of ramps (32, 32', 34, 34', 36, 36') made as a continuation of the grooves (15) on the parts (9, 10) and on the spine (14) and also in which the spacers (19') in the cover (10) are of a height corresponding to the height of said cylindrical spacers (38).

17 Claims, 10 Drawing Figures

CONTAINER HAVING CLOSURE GUIDE MEMBERS

The invention relates to containers for a number of fruit and vegetable products and the like which are particularly suitable for eggs and comprise two parts or portions, at least one of which is provided with recesses for the produce, held together and capable of being folded against each other by means of a spine and two parallel grooves bounding same and capable of being secured together by means of a closure of the press stud type. Containers of this kind, which are generally rectangular and of varying length depending on the number of items contained, are constructed from a sheet of thermoplastics material having a thickness of a few millimeters, are often filled and sealed by machines designed for the purpose, for which reason they are constructed with male and female closure guide members consisting of cylindrical projections with conical ends which can be inserted into cylindrical and conically hollowed cavities made between the recesses or along the peripheral edges of the container.

The said closure guide members made between the recesses and/or along the edges of the container are also constructed in a configuration other than a cylindrical configuration while making use of the same concept, although with poor results in every case either because they are placed at some distance from the spine or because the projections of the male and/or female members have to be of a restricted height with respect to the surfaces bounding the edges of the cavities in order to be usable with the container filling and closing machines now in use.

It very often happens in fact that the closures flatten against each other, fail to make a closure or do so inadequately instead of mating together correctly.

It is an object of the present invention to provide closure guide members which make it possible for the spine of the container to be placed in a plane at right angles to the plane or planes in which the two parts of the container meet so as to avoid the disadvantages described.

According to the present invention there is provided a container having closure guide members for eggs, fruit or like products which container is constructed from a sheet of synthetic thermoplastics material and is formed of two parts held together by a flat spine and by two grooves bounding the spine, and having recesses to house the products in at least one of the parts which have mating ledges and cylindrical spacers, the said parts being capable of being closed together by means of pressure closure members in such a way that the said mating surfaces are in contact with each other, in which the closure guide members consist of ramps made as a continuation of the grooves on the parts and on the spine and also in which the spacers in the cover are of a height corresponding to the height of said cylindrical spacers.

The present invention will be further illustrated, by way of example, with reference to the accompanying drawings, in which.

Figure 2:
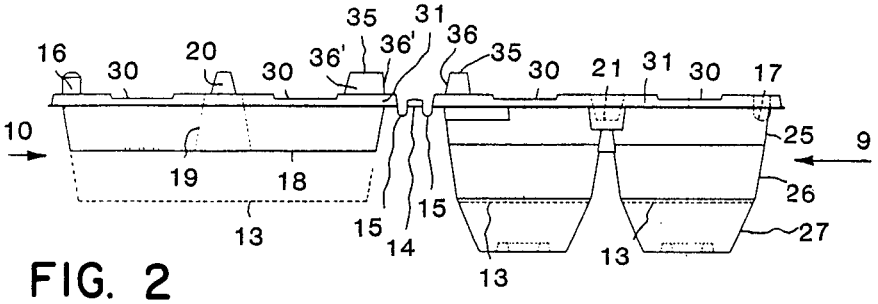
FIG. 2 is a side view of the container in the open position.
Figure 1:
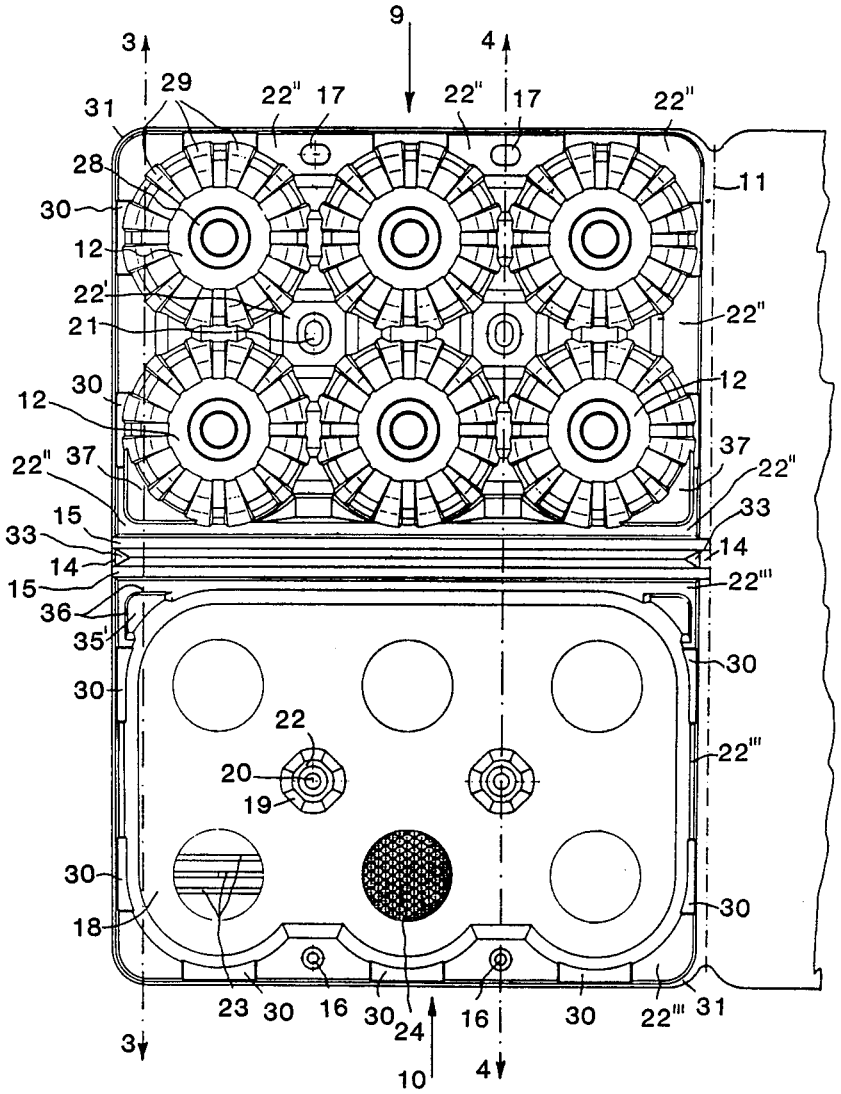
FIG. 1 is a plan view of a container in the open position alongside another container which is partly indicated by means of its outline only.
Figure 5:
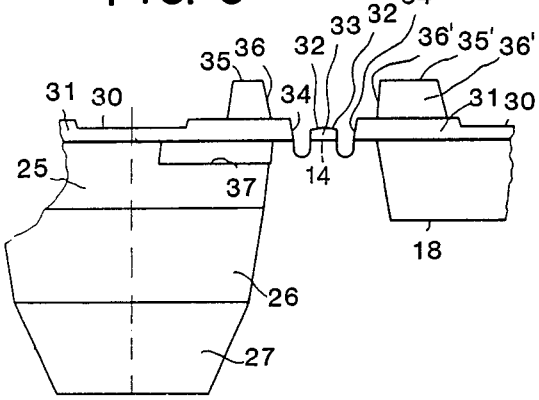
FIGS. 5 and 6 are partial diagrammatic side views of the container in the open and closed positions respectively.
Figure 6:
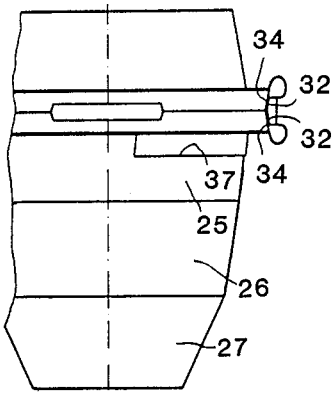
Figure 7:
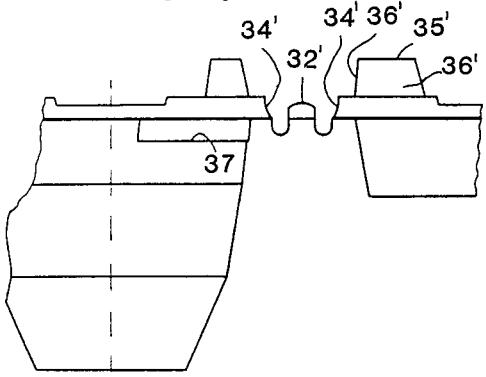
Figure 8:
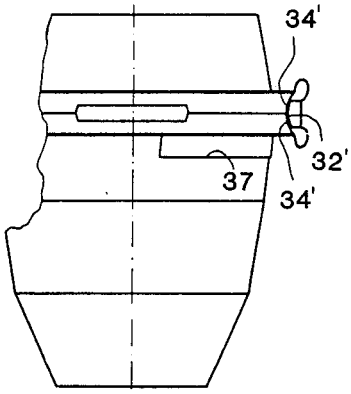
Figure 10:
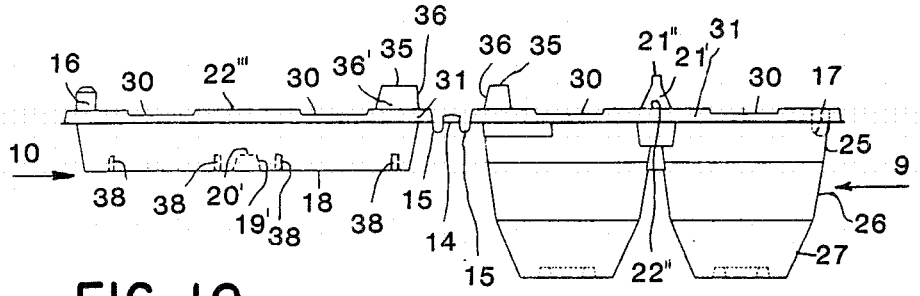
Figure 9:
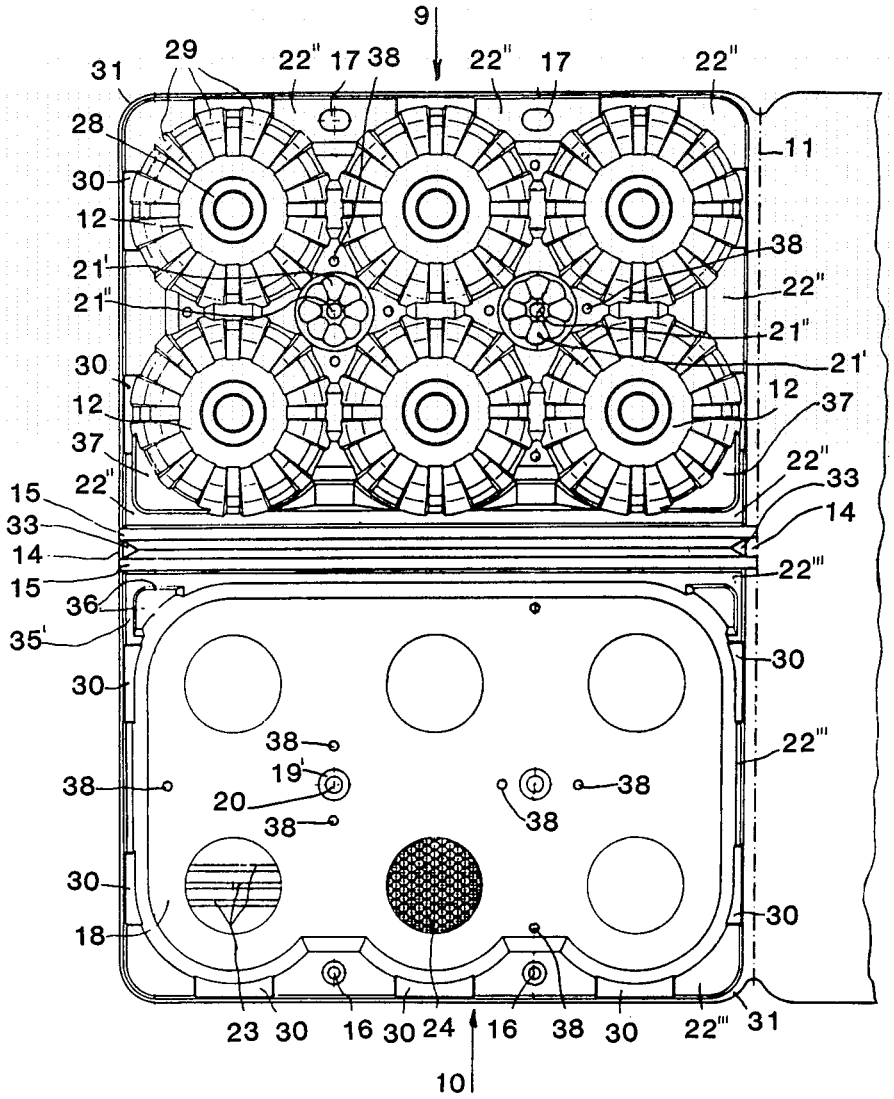

FIGS. 7 and 8 are partial diagrammatic side views of an alternative arrangement corresponding to those of FIGS. 5 and 6; and FIGS. 9 and 10 are similar views to those of FIGS. 1 and 2 of another embodiment.

As illustrated in FIGS. 1 and 2, the container consists of two parts or portions 9 and 10 connected to similar parts 9 and 10, of which only the outline is partly indicated on the right of FIG. 1, by means of a predetermined weak fracture line 11.

Each part 9, or body of the container, is provided with recesses 12 to house the produce whereas part 10, or the cover of the container, is designed to contain the parts of the produce which project from the recesses 12 although it does not include individual recesses.

Although not illustrated in the drawings the two parts of the container may each include recesses, each designed to contain half of each individual item and it is clear that in this situation the depth of the two parts will be that shown by dashed line 13, as shown in FIG. 2, without the principal characteristics of the invention being affected thereby.

Parts 9 and 10 are held together and can be folded back on each other by means of a spine 14 which is bounded laterally by two grooves 15, by which means the container can be closed with press studs having a male portion 16 which is substantially cylindrical with a conical point and a female portion 17 comprising a cavity with an elliptical edge in order to assist elastic yielding of the said edge as the male portion is inserted.

Two frusto-pyramidal spacers project inwardly from the top surface 18 of cover 10 and end in mating ledges 22 each of which correlates with a frusto-conical projection 20 which can be inserted into elliptically edged cavities 21 made in the mating ledges 22' between cover 10 and body 9. These spacers 19, together with the side walls of cover 10, prevent deformation of top surface 18 when the closed containers are stacked on top of each other. Parallel grooves 23, which can also be replaced by intersecting grooves 24, are also made in cover 10 to form a cushion between the tops of the products placed in recesses 12 and the top surface 18 of cover 10.

The said grooves 23 and 24 are particularly useful when the packed products are sensitive to pressure, such as eggs for example, and are transformed into air cushions when labels advertising the products are glued to the top surface 18 covering the two grooves 23 and 24.

It is clear that complete labels have an area equal to that of the top surface 18 and must be applied when the container is closed and already filled with eggs if these are to be protected.

Recesses 12 are substantially frusto-conical with side walls having three sections 25, 26, 27, see FIG. 2, of differing conicity which improve the presentation of the products when the container is made of transparent material and have ends with annular projections 28, which are themselves known, to secure the products by elastic means, while the side wall of each recess 12 is provided with elastific grooves 29 in a radial direction and rigid grooves in a vertical direction.

The recesses 12, along the peripheral zone of the container end at mating ledges 22'' which have recesses 30 associated with similar recesses 30 on mating ledges 22''' of cover 10 to act as ventilation apertures.

Figure 3:
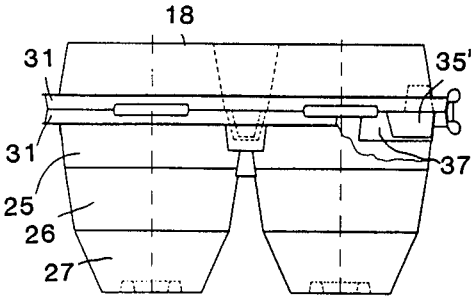
FIG. 3 is a diagrammatic side view, similar to that of FIG. 2, of the container in a closed position from which a part has been removed in order to provide a cross-sectional view of a ramp taken along the line 3—3 of FIG. 1.
Figure 4:
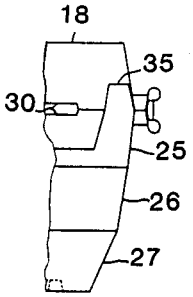
FIG. 4 is a partial diagrammatic view of the container in the closed position from which a part has been removed in order to provide a cross-sectional view of a ramp taken along the line 4—4 of FIG. 1.

When the container is opened ledges 22'' and 22''' are in the same plane as ledges 22' and 22, see FIG. 1, and end outwardly in edges 31, see also FIG. 3.

Again it will be noted from FIG. 3 that cover 10 is substantially frusto-pyramidal with a rectangular base, as will be seen in FIG. 1, and its side portions have recesses only where they correspond to male portions 16 of the pressure closure and form ridges broadly connected to the four corners.

With particular reference to FIG. 5 it will be seen that the spine 14 comprises two lateral ramps or inclined planes 32 and two end ramps 33 which end at the lower profile of edge 31 instead of being flat as in the embodiments currently in use.

As cover 10 is turned to close the container, the ramps 32 come into contact with at least one of ramps 34 formed as a continuation of grooves 15 in the body 9 and cover 10 and thus force the spine to take up a position at right angles to the mating ledges 22, 22', 22'', 22'''.

Once closed, as can be seen in FIG. 6, the ramps 32 mate with the ramps 34.

An alternative embodiment of the spine 14 is illustrated in FIGS. 7 and 8 and has a bowed wall 32' instead of ramps 32, the radius of curvature of which corresponds to that of ramps 34', this having an equivalent function to ramps 34 illustrated in FIG. 5.

As can be seen in FIG. 8, the ramps 32' and 34' again mate together in this embodiment.

The end ramps 33 of the spine 14 may also be provided in greater number instead of the two at the ends of the spine as shown in FIG. 1 in order to divide up the spine into a number of contiguous sections without thereby affecting the function of the spine.

As can be seen in FIGS. 1,2,4, 5 and 7, two frustopyramidal teeth 35 rise from mating ledges 22'' of the body 9 adjacent to the spine 14 and the side 36 of the teeth 35 facing the spine 14 provide a ramp for the ridge between mating ledge 22''' and the side wall of the cover 10 close to the spine 14 during the rotation which brings down cover 10 to close the container. Any contact between the said ridge and the ramps 36 prevents the spring 14 from taking up an incorrect position as the container is closed. In fact, as the cover approaches the position in which the container is closed, the ramps 36 act as if cover 10 was displaced so as to cause the spine 14 to take up a position coinciding with a plane at right angles to the plane of the mating ledges 22, 22', 22'', 22'''. It is clear to one skilled in the art that the teeth 35 may be more than two in number and that some may be made in the body 9 and others in the cover 10 so as to push or pull on cover 10 so that the spine 14 adopts its correct position thereby avoiding any crushing of the male and female members of the pressure closure. An alternative embodiment of teeth 35 is illustrated in FIGS. 1, 2, 3, 5 and 7, in which these are located close to the corners of the body 9 or the cover 10.

In situations such as these, the teeth 35' advantageously each have two ramps 36', and in the arrangement illustrated in the drawings they act on the ridge between mating surface 22'' and the corner wall 37 of the recess which opens opposite recess 12.

It is clear to one skilled in the art that the ramps 36, 36' facing grooves 15 may be constructed as a continuation or extension of the ramps 34 and 14' without being altered in their function thereby.

With particular reference to FIGS. 9 and 10, the container according to the invention is provided with cylindrical spacers 38, which are themselves known to those skilled in the art, in order to keep open empty containers at a slight distance from each other when stacked so as to prevent them from binding together, a situation which gives rise to particular difficulty when they are separated mechanically. In addition, the container in FIGS. 9 and 10 is constructed with frusto-conical spacers 19' in the cover 10 which are of the same height as the cylindrical spacers 38 and end in mating ledges 20' with the ends 21'' of spacers 21' made in the body 9 of the container.

These alternative embodiments make it possible to apply complete labels to the covers of empty containers before they are stacked, and this can be done without any damage to the label.

It is also clear that when the container is constructed according to FIGS. 9 and 10, the mating ledges 21'' are at the same distance from the mating ledges 22'' as the mating ledges 20' are from the ledges 22''' so that the ledges 22'' can mate with the ledges 22''' when the container is closed.

I claim:

1. A container having closure guide members for eggs, fruit or like products, which container is constructed from a sheet of synthetic thermoplastics material and is formed of two portions held together by a flat spine and by two grooves binding the spine, and having recesses to house the products in at least one of the portions which have mating ledges and cylindrical spacers, the said portions being capable of being closed together by means of pressure closure members in such a way that the said mating ledges are in contact with each other, in which the closure guide members comprise a ramp made as a continuation of the grooves on the portions and a ramp on the spine, the ramps matingly engaging one another to align the two portions during closure of the container, and also in which additional spacers are provided and are of a height corresponding to the height of said cylindrical spaces.

2. A container as claimed in claim 1, in which the ramps end directly at the base of the spine.

3. A container as claimed in claim 1, in which the ramps consist of inclined planes.

4. A container as claimed in claim 1, in which the ramps have curved surfaces.

5. A container as claimed in claim 1, in which the ramps are connected to the base of the spine by ramps at least at their ends.

6. A container comprising: first and second portions, at least one of the portions having compartments therein for accommodating a product; a spine between the first and second portions; a strip member defining a groove on each side of the spine, each strip member being fixed along one edge thereof to the spine and along the other edge thereof to the first or second portion respectively so that the first and second portions can move relative to each other between a closed and an open position; and closure guide means to facilitate proper alignment of the first and second portions during closure of the container, the guide means comprising a pair of spine ramps on the spine, and a ramp on each of the first and second portions adjacent the strip member which matingly engages one of the pair of spine ramps respectively during closure of the container.

7. A container as claimed in claim 6 further comprising closure means for holding the first and second portions together when in the closed position.

8. A container as claimed in claim 6 wherein the closure guide means further comprises a projection on one of the portions, the projection having a ramp thereon, and a corresponding recess in the other portion, the recess defining a ramp which matingly engages the ramp on the projection during closure of the container.

9. A container as claimed in claim 8 wherein the projection and corresponding recess are located on the respective portions adjacent the spine.

10. A container as claimed in claim 8 wherein a plurality of projections and corresponding recesses are provided on the container.

11. A container as claimed in claim 6 further comprising spacers to prevent deformation of the portions when the container forms part of a stack.

12. A container as claimed in claim 11 wherein each of the portions of the container includes a ledge which matingly engages a corresponding ledge on the other portion when the container is in the closed position.

13. A container as claimed in claim 12 wherein the spacer comprises a protrusion on the ledge of one portion and a registering cavity in the corresponding ledge of the other portion, the protrusion being received within the registering cavity when the container is in the closed position.

14. A container as claimed in claim 6 further comprising one or more additional spacers adjacent each compartment, the additional spacers preventing deformation of empty compartments within the container when the container forms part of a stack.

15. A container as claimed in claim 6 wherein the ramps consist of inclined planes.

16. A container as claimed in claim 6 wherein the ramps have curved surfaces.

17. A container as claimed in claim 6 wherein the container is constructed from a sheet of synthetic thermoplastic material.

* * * * *